United States Patent [19]

Hayes

[11] 4,121,720

[45] Oct. 24, 1978

[54] APPARATUS FOR DISPLAYING JEWELRY

[76] Inventor: Doris A. Hayes, 2714 S. Zurich Ct., Denver, Colo. 80236

[21] Appl. No.: 761,550

[22] Filed: Jan. 21, 1977

[51] Int. Cl.[2] ..... A47F 5/08

[52] U.S. Cl. ..... 211/113; 248/317

[58] Field of Search ..... 248/317, 318, 301, 304; 211/113, 115, 13, 119, 163, 182

[56] References Cited

U.S. PATENT DOCUMENTS

| | | | |
|---|---|---|---|
| 908,548 | 1/1909 | Cloud | 211/115 |
| 919,574 | 4/1909 | Hayes | 211/163 |
| 1,078,729 | 11/1913 | Hill | 211/115 |
| 1,344,027 | 6/1920 | Evilsizor et al. | 248/317 X |
| 1,809,195 | 6/1931 | Evans | 211/163 |
| 2,595,837 | 5/1952 | Freeman | 211/163 |
| 3,228,577 | 1/1966 | Croft | 248/318 X |
| 3,339,745 | 9/1967 | Sugerman | 211/13 |
| 3,765,541 | 10/1973 | Madey et al. | 211/182 |

FOREIGN PATENT DOCUMENTS

| | | | |
|---|---|---|---|
| 1,279,939 | 11/1961 | France | 211/163 |
| 79,124 | 12/1933 | Sweden | 248/304 |
| 306,805 | 4/1955 | Switzerland | 211/163 |

*Primary Examiner*—Roy D. Frazier
*Assistant Examiner*—Terrell P. Lewis
*Attorney, Agent, or Firm*—Gary M. Polumbus

[57] ABSTRACT

An apparatus for displaying jewelry includes a plurality of vertically spaced horizontally disposed display rings retained in a concentric orientation by a center support rod and a plurality of connecting members extending between adjacent rings. At least one of the rings has a plurality of outwardly protruding fingers adapted to support ring-type jewelry while other of the display rings include hook means for supporting bracelets, necklaces and the like and openings therethrough for receiving earrings. The center support post may have a mirror there around for decorative purposes and the entire apparatus can be suspended from a supporting surface or supported on a support stand.

3 Claims, 4 Drawing Figures

APPARATUS FOR DISPLAYING JEWELRY

BACKGROUND OF THE INVENTION

The present invention relates generally to apparatus for storing jewelry and more particularly to an aesthetically pleasing display apparatus which supports and removably retains jewelry in a manner so that selected pieces of jewelry do not become entangled with other pieces of jewelry.

For years, most women of the world have collected and worn various articles of jewelry as a means of enhancing their personal appearance. Due to the large assortment of jewelry available, most women accumulate a number of pieces of jewelry and because of the nature of the physical characteristics of the jewelry, it is difficult to keep these various articles of jewelry separated and properly displayed for selection for use. Most devices which have been devised for retaining jewelry in a neat and orderly fashion have included closable boxes having various tiers for keeping the jewelry separated but in a common location.

Jewelry, by its very nature, is very attractive and therefore can provide ornamentation even while in storage and to this end the apparatus of the present invention has been designed to not only retain jewelry in a separated and orderly fashion but also in a manner such that the jewelry is on display and thereby serves as a decorative furnishing in the home or other abode of the owner of the jewelry.

SUMMARY OF THE INVENTION

The apparatus of the present invention is adapted to be supported on a horizontal surface or be suspended from a ceiling or vertical surface and is adapted to temporarily retain articles of jewelry in a manner such that they are maintained in an orderly fashion and displayed for decorative purposes.

The apparatus includes a display disc and a plurality of vertically spaced horizontally disposed display rings which are operatively interconnected so as to retain a fixed relationship with each other. The display disc, which is the uppermost display element, is supported by a center support member extending along the center of the display disc while the display rings are suspended from each other and from the display disc by connection elements. The lowermost display ring is retained in position relative to the center post by radiating chain elements.

At least one of the rings or the disc includes a plurality of generally radial protrusions adapted to support and temporarily retain ring-type jewelry while others of the rings include hook members for supporting jewelry articles such as necklaces, bracelets and the like. Some of the display rings include openings therethrough so that pierced-ear type earrings can be stored at the display ring and the display rings are designed to support clip-type earrings in an attractive and appealing manner.

As will be appreciated with the detailed description hereinafter, the apparatus of the invention retains the jewelry so that each article is separated from other articles of jewelry and so that they do not become entangled and are, therefore, easily removable from the apparatus. The jewelry is also retained in a manner such that the jewelry is displayed attractively thereby providing a decorative furnishing for the room in which the apparatus is located.

Other objects and advantages of the present invention will become apparent with the detailed description which follows.

DESCRIPTION OF THE PREFERRED EMBODIMENT

Figure 1:
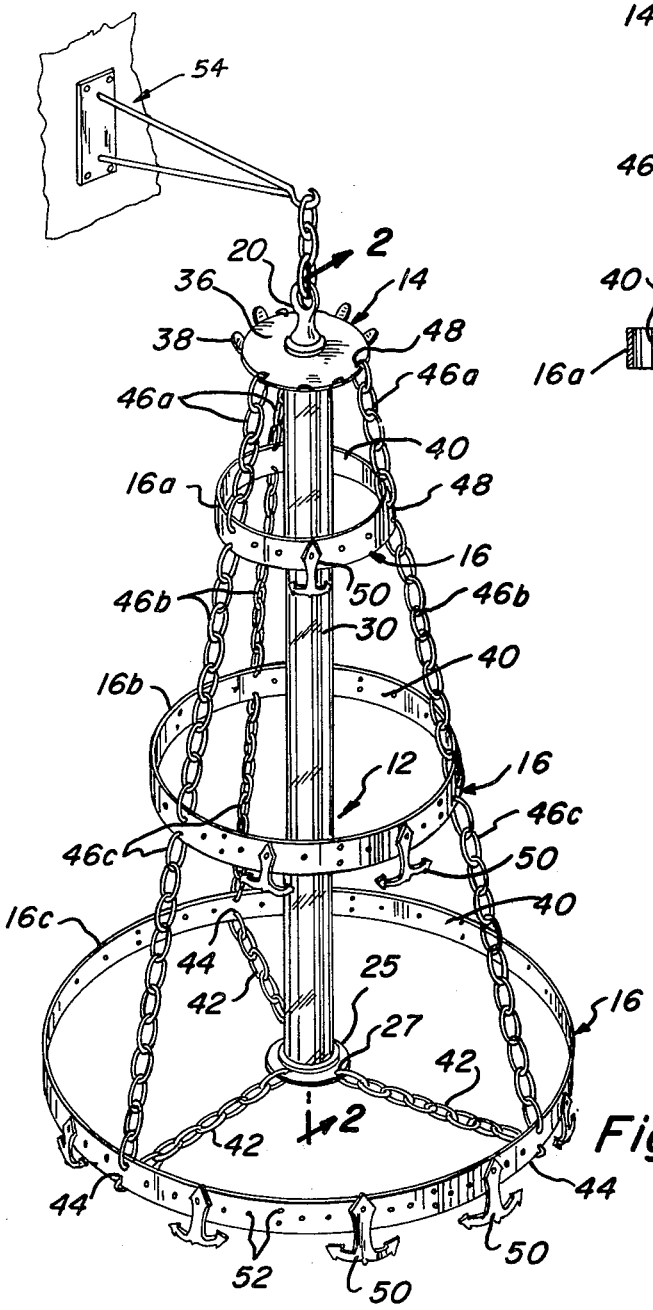
FIG. 1 is a perspective view of the apparatus of the present invention suspended from a vertical wall.

Referring first to FIG. 1, the apparatus 10 of the present invention can be seen to include a vertically extending support member 12 having a display disc 14 disposed on the upper end thereof and three concentric horizontally disposed and vertically spaced display rings 16 positioned therefrom with the display rings increasing in diameter from the uppermost ring **16*a* to the lowermost ring 16*c***.

Figure 2:
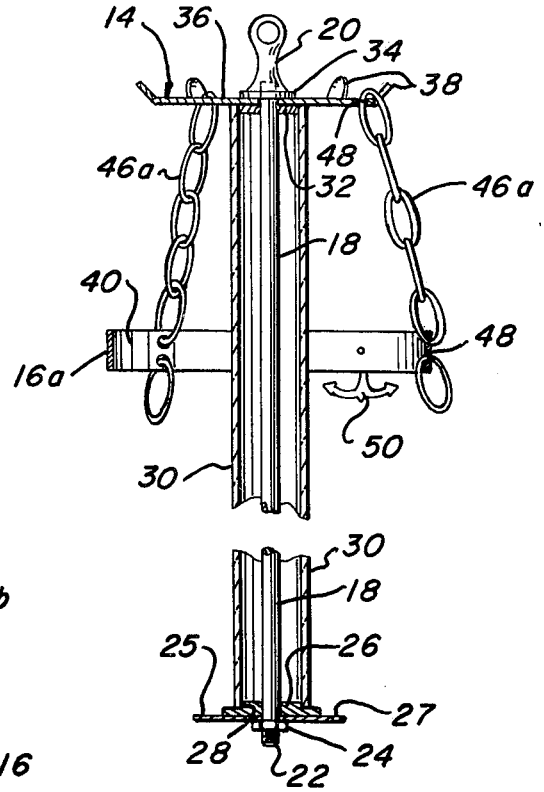
FIG. 2 is an enlarged fragmentary section view taken along line 2—2 of FIG. 1 with parts removed for clarity.

The support member 12 is seen best in FIG. 2 to include an elongated rod 18 with an ornamental head fixture 20 on its upper end. The lower end 22 of the rod is threaded and receives a nut 24 which supports circular element 25 and a disc like element 26 on the lower end of the rod. The circular element 25 has a plurality of regularly spaced holes 27 formed around the perimeter thereof, and the disc like element 26 has an annular groove 28 found in its upper surface around the perimeter thereof.

In one form of the invention, a cylindrical mirror 30 is disposed on the support rod 18 with the lower end of the mirror seated in the annular groove 28 on the disc element 26 and the upper end having a washer member 32 therein with a centrally located opening through which the support rod passes. The display disc 14 is seated on the upper end of the cylindrical mirror and positioned on the support rod 18 a shoulder portion 34 of the ornamental head 20 so that the display disc, support rod and cylindrical mirror are all positively positioned.

As best seen in FIGS. 1 and 2, the display disc 14 in the preferred form consists of a central portion 36 of flat sheet metal or plastic material formed in a circular configuration with a plurality of circumferentially spaced generally radially protruding fingers 38. In the disclosed embodiment, the fingers 38 are not only radially disposed relative to the flat central portion 36 of the display disc but are also directed upwardly at an angle of approximately 45°. The finger-like protrusions 38 are approximately $\frac{1}{4}$ inch to $\frac{1}{2}$ inch in width so as to be adapted to receive and removably retain ring-type jewelry (not shown). In other words, the ring-type jewelry can be positioned over a finger 38 on the display disc and be retained in position by gravity forcing the ring-type jewelry piece inwardly against the central circular portion 36 of the display disc.

In the disclosed embodiment, each of the upper, middle and lower display rings **16*a*, 16*b* and 16*c* respectively are identical except, as mentioned before, the middle display ring 16*b* has a larger diameter than the upper display ring 16*a* and the lower display ring 16*c*** has a larger diameter than the middle display ring 16*b*. Structurally, the rings include a circular band 40 of metal or plastic material of rectangular cross-section. Three spoke-like chain elements 42 extend inwardly from the bottom most band 16*c* to the circular element 25, and a radially inward portion of each chain element 42 is received in a hole 27. A radially outer portion of each chain element 42 is received in a hole 44 formed at equally spaced intervals around the periphery of display ring 16*c*.

In the disclosed form of the invention, the uppermost display ring 16*a* is suspended from the display disc 14 by three circumferentially spaced chain elements 46*a* which have opposite ends protruding through openings 48 provided at circumferentially spaced locations around the display disc and uppermost display ring and with the chain elements 46*a* being retained in the openings 48 by passing a link of the chain element therethrough. The openings 48 are aligned so that the chain elements 46*a* lie in vertical planes. Similarly, the upper display ring 16*a* supports the middle display ring 16*b* with three circumferentially spaced chain elements 46*b* interconnecting the two rings in the same manner in which the display disc 14 supports the upper display rings 16*a*. Likewise, the lowermost display ring 16*c* is supported from the middle display ring 16*b* in the same manner with three circumferentially spaced chain elements 46*c*.

Figure 3:
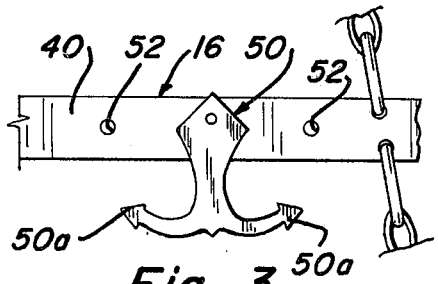
FIG. 3 is an enlarged fragmentary view of a portion of one of the display rings of the apparatus of FIG. 1.

In the disclosed embodiment shown in FIGS. 1 and 3 each of the display rings 16 includes a plurality of circumferentially spaced support hooks 50 having a pair of arcuate oppositely directed and upturned hook elements 50*a* which are adapted to support and removably retain various types of jewelry including elongated flexible pieces such as necklaces, bracklets and the like (not shown). Each of the hook members 50 is secured to its associated display ring 16 in any suitable manner by riveting, gluing, welding or the like. Between adjacent hook members 50 a display ring, the display rings are provided with horizontal openings 52 through the band portion 40 of the display ring with the openings 52 being adapted to receive earrings for pierced ears (not shown). As will be appreciated, the earrings are secured through the band of a display ring just as they are secured to the earlobe of one who wears the pierced earrings. As should also be appreciated, the bands are of a width, approximately ⅛th inch, so that conventional earrings (not shown) of the clamp type can be positioned along the top edge of the band portion of the display ring and clamped thereon just as they would be clamped on the earlobe of one wearing the earrings.

It will be appreciated that depending upon the needs of the individual using the apparatus 10 of the display rings 16 could include fingers 38 similar to that found on the display disc 14, so that ring-type jewelry could be retained on the display rings as well as on the display disc. Likewise hooks or other means for displaying other types of jewelry could be provided on the display disc.

Figure 4:
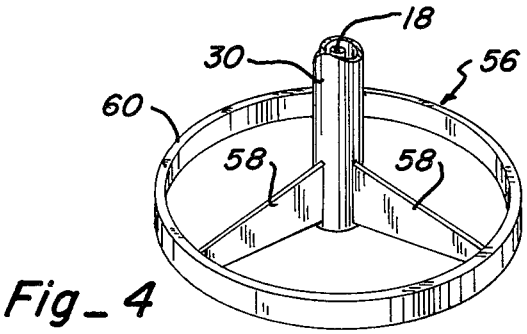
FIG. 4 is a perspective view of a base member illustrating another embodiment for supporting the apparatus of the present invention.

The display apparatus described hereinbefore can be supported in any one of numerous ways. In FIG. 1, a wall bracket 54 is shown supporting the apparatus in a suspended manner but the apparatus could be suspended from the ceiling or supported with a base support 56 as illustrated in FIG. 4. In this embodiment, the cylindrical mirror member 30 would not terminate at the lower ring 16*c*, as shown in FIG. 1, but rather would be continuous into the base member 56 which could include a plurality of radiating support ribs 58 connected to the cylindrical mirror and terminating at their outer ends in a support ring 60.

While certain illustrative embodiments of the present invention have been shown in the drawing and described above in detail, it sould be understood that there is no intention to limit the invention to the specific form disclosed. On the contrary, the intention is to cover all modification, alternative constructions, equivalents and uses falling within the spirit and scope of the invention as expressed in the appended claims.

I claim:

1. Apparatus for displaying articles of jewelry including rings, necklaces, bracelets and earrings comprising in combination:

an elongated central support member;

means operatively associated with said support member for positioning said support member in a substantially vertically extending position, a disc member of substantially solid construction connected to the upper end of said support member and extending substantially transversely from the upper end thereof, the outer edge of said disc member being substantially circular;

a plurality of fingers connected to the outer circular edge of said disc member and angled upwardly with respect to said disc member and with respect to a horizontal reference, said fingers being of a size adapted to receive and removably retain ring-type jewelry;

a plurality of vertically spaced display rings, each display ring being a circular band of rectangular cross-section which defines an opening within the center of the circular band, each display ring being disposed with the circular band lying essentially in a horizontal plane and with said central support member extending vertically through the opening within the center of the circular band, at least one of said display rings having circumferentially spaced openings formed through the circular band adapted to receive and removably retain earrings, and at least one of said display rings having hooks attached to the circular band adapted to receive and removably support elongated flexible articles of jewelry;

a first plurality of elongated flexible connecting members extending downwardly from the outer circular edge of said disc member to the circular band of the upper one of said display rings, said first plurality of connecting members operatively suspending the upper one of said display rings in a vertically spaced relationship below said disc member;

a second plurality of elongated flexible connecting members extending between the circular bands of adjacent vertically spaced display rings to operatively suspend the others of said display rings below and from the upper one of said display rings;

a third plurality of elongated flexible connecting members extending substantially transversely from said central support member to the lower one of said display rings; and said first, second and third pluralities of connecting members being connected at equally circumferentially spaced intervals to said display rings.

2. Apparatus as recited in claim 1 wherein said elongated central support member includes a generally cylindrical outer surface of mirror-like characteristics.

3. Apparatus as recited in claim 1 wherein at least one of said display rings includes both openings therethrough adapted to receive earring-type jewelry and hooks connected thereto adapted to receive elongated flexible articles of jewelry.

* * * * *